US006940464B2

(12) United States Patent
Petersson et al.

(10) Patent No.: US 6,940,464 B2
(45) Date of Patent: Sep. 6, 2005

(54) REFLECTOR AND ANTENNA SYSTEM CONTAINING REFLECTORS

(75) Inventors: Mikael Petersson, Göteborg (SE); Per Ingvarson, Mölndal (SE)

(73) Assignee: Saab Ericsson Space AB, Gothenburg (SE)

( * ) Notice: Subject to any disclaimer, the term of this patent is extended or adjusted under 35 U.S.C. 154(b) by 0 days.

(21) Appl. No.: 10/470,971

(22) PCT Filed: Feb. 2, 2002

(86) PCT No.: PCT/SE02/00188

§ 371 (c)(1),
(2), (4) Date: Dec. 11, 2003

(87) PCT Pub. No.: WO02/061882

PCT Pub. Date: Aug. 8, 2002

(65) Prior Publication Data

US 2004/0085254 A1 May 6, 2004

(30) Foreign Application Priority Data

Feb. 2, 2001 (SE) ..... 0100345

(51) Int. Cl.[7] ..... H01Q 13/00
(52) U.S. Cl. ..... 343/781 P; 343/836
(58) Field of Search ..... 343/756, 779, 343/781 P, 835, 836

(56) References Cited

U.S. PATENT DOCUMENTS 2,790,169 A 4/1957 Sichak
4,388,623 A 6/1983 Crook et al.
4,625,214 A 11/1986 Parekh
4,916,459 A * 4/1990 Kurosawa et al. ..... 343/840
6,064,352 A * 5/2000 Silverman et al. ..... 343/912

FOREIGN PATENT DOCUMENTS

| | | |
|---|---|---|
| DE | 3027095 | 12/1982 |
| EP | 0466576 | 1/1992 |
| GB | 795428 | 5/1958 |
| GB | 1457907 | 12/1976 |

* cited by examiner

*Primary Examiner*—Shih-Chao Chen
(74) *Attorney, Agent, or Firm*—Swidler Berlin LLP

(57) ABSTRACT

The invention concerns a reflector and a satellite antenna system comprising such a reflector. In the satellite antenna system, microwave radiation from one or more feed horns (5) is emitted at the reflector (1), which comprises first and second reflector elements (2, 3). Upon reflection of the radiation from the reflector elements (2, 3), a distinct beam shape for the reflected microwave energy is generated. The reflector elements (2, 3) are disposed at a fixed distance from one another so that radiation that passes the first reflector element (2) strikes the second element. The first reflector element (2) comprises a lattice structure aimed toward the feed horn, which lattice structure consists of plates (8) of electrically conductive material, wherein the distance between the plates and the depth of said plates are adapted for reflection of polarization parallel to the plates. The invention is characterized in that the extent of each respective plate toward the second reflector element is chosen so that the transmission losses in the first reflector element are minimized.

7 Claims, 2 Drawing Sheets

REFLECTOR AND ANTENNA SYSTEM CONTAINING REFLECTORS

TECHNICAL AREA

This invention concerns a reflector with first and second reflector elements disposed relative to one another in such a way that radiation that passes the first reflector element strikes the second reflector element, wherein the first reflector element comprises a lattice structure of electrically conductive plates disposed at a uniform distance from one another, wherein the distance between the plates and the depth of said plates are adapted for the reflection of polarization parallel with the plates. The invention also concerns a satellite antenna system in which microwave radiation is emitted from one or more feed horns toward the reflector.

BACKGROUND AND PROBLEM OF THE INVENTION

Communication satellites furnish signals to large geographical areas on the ground. Specially adapted antenna designs make it possible to provide signal coverage for a particular reception area or country. An antenna system comprising one or a plurality of feed horns that transmit microwave radiation toward a reflector with a shaped reflecting surface can be used to achieve satisfactory receiver performance.

By creating satellite antenna systems with dual reflectors it is possible, at relatively low additional cost, to coordinate two separate antennas into a single antenna system. The respective reflectors are equipped with individually designed reflecting surfaces. The reflectors are arranged as upper and lower reflectors at a specific distance from one another. Fastening to the satellite is achieved by using the same fastening mechanism for the two reflectors, which are otherwise substantially independent of one another. Each reflector comprises a reflecting surface that reflects incident radiation from the feed horns with a specific direction of polarization.

In order for incident radiation to be able to penetrate down to the underlying reflector, these antenna systems are designed as "dual-grid" antennas. Such antennas are characterized in that the upper reflector consists of a partially RF-transparent structure that reflects only radiation that exhibits a particular direction of polarization. Two feed horns aimed toward the reflectors emit microwave radiation with orthogonal directions of polarization. These reflectors are arranged in such a way that the microwaves from a first feed horn are reflected by an upper reflector, which is arranged so as to reflect microwaves having the direction of polarization derived from the first feed horn. A second feed horn emits microwaves with a direction of polarization that is orthogonal to that of the radiation from the first feed horn. As a result, substantially all of the radiation from the second feed horn passes the first reflector and is reflected by a second, underlying reflector. The polarization sensitivity of a first reflector that is aimed toward the feed horn is achieved in that a band lattice structure is applied to the surface of the reflecting dielectric reflector. This lattice structure can consist of, e.g. a plurality of parallel copper conductors coating a substrate. The distance between the lattice band on one reflector surface is made small enough to cause the incident microwave energy, whose electrical field is polarized parallel to the lattice band of the reflecting surface, to be reflected. The second reflector can also include a reflecting surface with a polarization-sensitive lattice structure, or a surface that reflects all the incident radiation. Conventional dual-grid antennas use reflectors made of a dielectric material such as Kevlar.

Antennas with polarization-sensitive reflection are known from numerous publications. German patent DE, C 958 668 describes a reflector antenna with dual reflecting surfaces. The reflecting surfaces described in the patent consist of a number of conductors comprised of metal rods oriented in parallel with the reflecting direction of polarization. However, this type of antenna cannot be used under the special conditions imposed by in-space applications, since far too many rods would be needed to achieve sufficient reflection in the relevant frequency band. This antenna is also unable to meet in-space requirements in terms of rigidity and thermal stability.

U.S. Pat. No. 2,790,169 describes yet another antenna for polarization-sensitive reflection from two reflector elements. The first reflector element consists of a flat or parabolic bottom plate. The second reflector element consists of a number of parallel conductors that are fixedly mounted in the bottom plate at a uniform distance from one another. Complete reflection of radiation with a particular degree of polarization can be achieved by adjusting the extent of these conductors above the bottom plate (the depth of the conductors), and their mutual separation. This antenna assumes contact among the conductors that together comprise the first reflector element and the underlying reflector. One problem with this antenna is that the design of the reflector elements results in high transmission losses. Nor can this antenna be adapted to meet in-space requirements in terms of rigidity and thermal stability.

U.S. Pat. No. 4,625,214 describes a conventional structure for satellite antennas with dual reflecting surfaces. The parabolic reflectors are constructed on the basis of honeycomb cores of, e.g. Kevlar material. The lattice pattern consists of parallel metal ribs that are fixedly secured to the surface of the parabolic reflector. This known design functions satisfactorily up to the KU band (12 GHz–22 GHz). The density required for the metal pattern at higher frequencies makes this technology difficult to use at frequencies above the KU band. The design and choice of materials also result in reduced electrical performance and dielectric losses.

DESCRIPTION OF THE INVENTION

One object of the present invention is to provide a reflector antenna that is an improvement over the state of the art, which means that the reflectors can function in higher frequency bands than previous design solutions, while the design of the reflector antenna is at the same time simplified.

This has been accomplished by means of a reflector according to claim 1, in which a first reflector element comprises a lattice structure of electrically conductive plates disposed at a uniform distance apart from one another, wherein the distance between the plates and the depth of said plates is adapted for the reflection of polarization parallel with the plates. The extent of each respective plate toward the second reflector element is chosen so that the transmission losses in the first reflector element are minimized.

In an alternative embodiment of the invention the plates in the lattice structure are arranged in such a way that each respective plate in the lattice structure exhibits a gradually changing angle in relation to the normal plane. By allowing the plates to assume varying angles relative to the normal plane depending on where they are located in the lattice structure, a reflector element with advantageous reflecting and transmitting properties vis-a-vis the incident radiation can be obtained.

In one embodiment the plates are made of a fiber-reinforced plastic, e.g. carbon fiber. In an embodiment using fiber-reinforced plastic, the plates can be coated with a thin metallic layer, which yields better electrical properties at high frequencies. This choice of materials enables lower electrical losses and better thermal stability. Preferred embodiments may exhibit one or more of the characteristics cited in the subordinate claims.

The invention also concerns a satellite antenna system comprising a feed horn arranged so as to emit microwave energy toward a reflector according to claim 1.

DESCRIPTION OF THE FIGURES

The invention will be described below using exemplary embodiments, and with reference to the accompanying figures, wherein.

DESCRIPTION OF EMBODIMENTS

Figure 1:
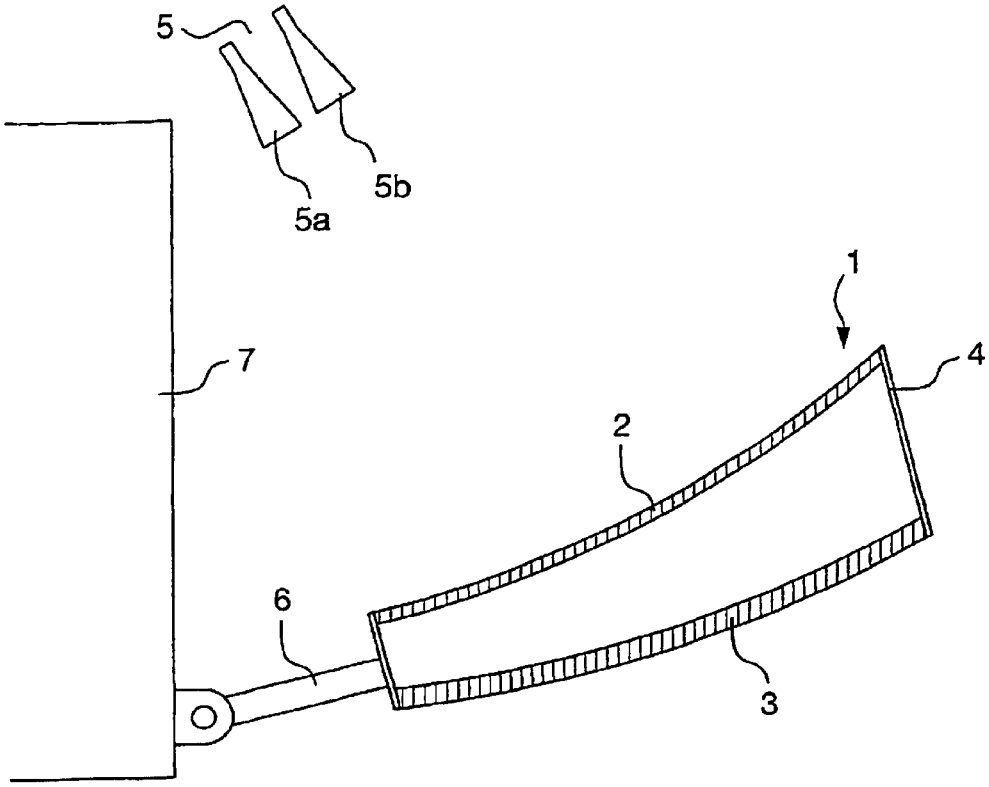
FIG. 1 shows the satellite antenna system according to the invention
Figure 2:
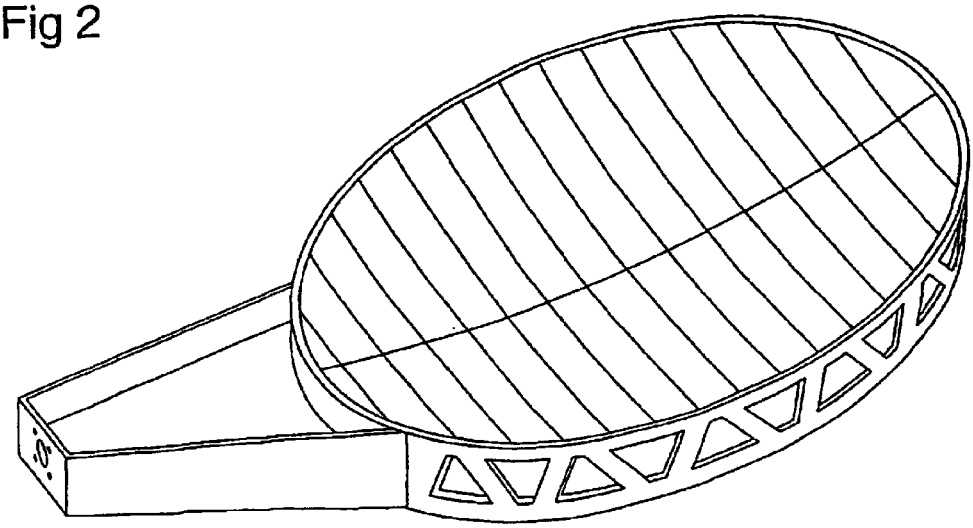
FIG. 2 shows the reflector according to the invention
Figure 3:
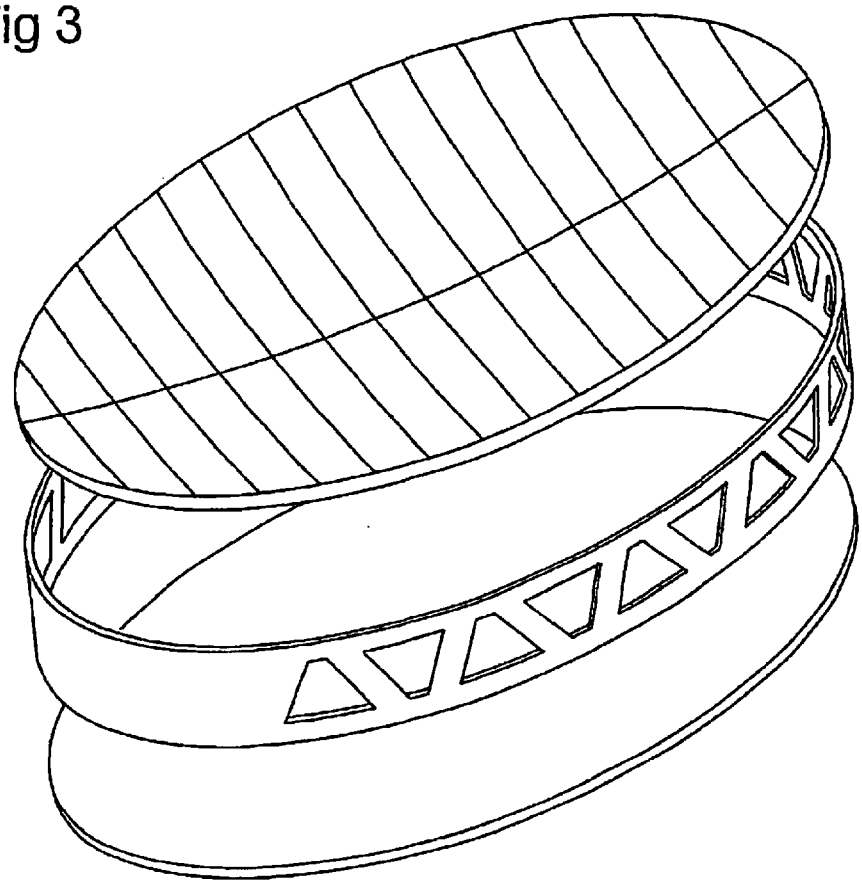
FIG. 3 shows a view of the parts involved in the reflector according to the invention

A satellite antenna system according to the invention is shown in FIG. 1. The antenna system comprises a reflector 1 with two reflector elements 2, 3 arranged at a set distance from one another in a frame 4. The frame 4 is connected via a fastening device 6 to the satellite body 7. This fastening device 6 can consist of a deployment mechanism, or be arranged so as to fixedly secure the reflector to the satellite body.

Two feed horns 5*a*, 5*b* that are aimed at the reflector 1 emit microwave radiation with orthogonal directions of polarization. The reflector 1 is arranged so that the microwaves from a first feed horn 5*a* are reflected by an upper reflector element 2, which is arranged so as to reflect microwaves having the direction of polarization derived from the first feed horn. A second feed horn 5*b* emits microwaves with a direction of polarization that is orthogonal to that of the radiation from the first feed horn 5*a*. As a result, substantially all the radiation from the second feed horn 5*b* will pass the first reflector element 2 and be reflected from a second underlying reflector element 3. The polarization sensitivity of the first reflector element 2 is achieved via a lattice structure in the reflector element. The lattice structure is designed so that incident microwave energy whose electrical field is polarized parallel to the lattice plates of the reflector surface is reflected. The second reflector element also comprises a reflecting surface with a polarization-sensitive lattice structure, or a surface that reflects all incident radiation.

The lattice structure in the first reflector element 2 consists of a plurality of plates 8 and gaps arranged side by side. Polarization sensitivity is achieved as a result of the lattice pattern on the reflector element 2. The distance between the plates 8 in the lattice structure of the first reflector element 2 and the depth of these plates cause the lattice to reflect incident microwave energy whose electrical field is polarized parallel to the plates 8 in the reflector element 2. Radiation with a different direction of polarization is transmitted on to the second, underlying reflector element 3. The second reflector element can consist of a lattice structure in the same way as the first reflector element, or of a solid reflective body. In the embodiment shown in FIG. 1 the second reflector element 3 consists of a solid reflective body whose entire surface is reflective, regardless of polarization. This embodiment is typical of a sandwich-type carbon fiber reflector.

The feed horn 5 is disposed in the area around the reflector focus, and arranged so as to radiate microwave energy at the reflector 1. With two feed horns 5*a*, 5*b*, the microwave radiation from a first feed horn 5*a* has imparted to it polarization such that the microwaves are reflected from the upper, first reflector element 2. The microwave energy from a second feed horn 5*b* has imparted to it polarization such that it passes through the first reflector element 2 and is reflected from the lower, second reflector element 3. The radiation reflected from the second reflector element 3 passes through the first reflector element 2 as a result of its direction of polarization.

The lattice structure of the first reflector element 2 can consist of an electrically conductive material such as carbon-fiber-reinforced plastic. The desired surface structure or topography can be achieved by milling or some other machining of the plates. The reflector element 2 is given a substantially parabolic shape, with a surface structure that is adapted for the desired propagation of the microwave radiation. The requirements for the fiber-reinforced plastic are that it must exhibit low thermal expansion, a high modulus of elasticity, low weight and high durability. Carbon-fiber laminate is an example of a fiber-reinforced plastic with suitable properties.

In order to improve the properties of the reflector element 2 at high frequencies and reduce the electrical losses at these frequencies, the surfaces of the plates can be provided with a metallic coating. The metallized surface consists in one embodiment of a light metal, e.g. aluminum, with a coating thickness of 1–15 $\mu$m, depending on the frequency of the antenna. Materials other than light metals are also possible in this context.

A uniform distance between the plates 8 can be achieved by means of sparsely arranged spacers 9 of a dielectric material. The spacers 9 must be made of material that offers low dielectric losses, low weight and a low coefficient of expansion. In one embodiment these spacers 9 are oriented orthogonally relative to the plates 8, but they can also be disposed at some other angular relationship to the plates. The spacers 9 consist of, e.g. Kevlar laminate or a thin and light Kevlar sandwich panel.

The first reflector element 2 typically has a substantially parabolic shape with a topographic surface structure that is designed to generate the desired beam shape in the desired direction. The design of the lattice structure determines the electrical properties of the reflector element 2. The distance between the plates, their heights and their thickness, together with the surface topography of the first reflector element 2, affect the electrical properties of this part of the antenna system. The plates are disposed so that their mutual spacing is somewhat less than one-half the space wavelength at the frequency being used. An exponential diminution of the polarization reflected is thereby achieved. Total reflection is achieved if the plates are of sufficient height.

Figure 4:
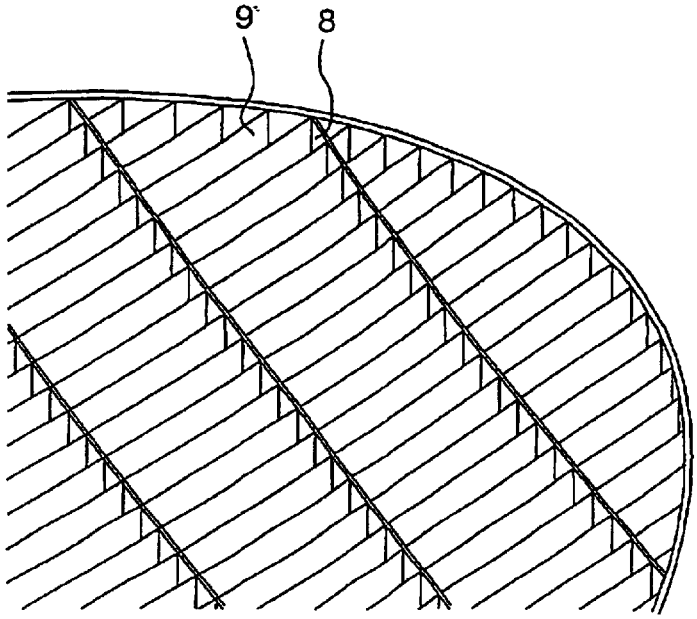
FIG. 4 shows an enlarged view of a portion of the first reflector element

In the embodiment of the plates 8 shown in FIG. 4, the plates are parallel to one another. However, it is also possible to arrange the plates so that they are nearly parallel, i.e. in such a way that each plate is turned by a slight angle in depth relative to the surrounding plates. The lattice structure can thus be adapted to the beam shape of the incident divergent beam striking the reflector at varying angles. Advantageous reflecting and/or transmitting properties can be obtained by gradually changing the angular relationship for each plate 8 relative to the normal plane.

As a result of the design of the lattice structure, a structurally functional structure with a reasonable number of plates 8 in the lattice structure can be achieved even at high frequencies.

The extent of the plates 8 toward the second reflector element 3 is chosen so that the transmission losses in the first reflector element 2 are minimized. Reflection for the polarization that is intended to be transmitted can be minimized by choosing the extent or depth of the plates. The plates 8 are consequently given different extents in depth, depending on where these plates 8 are disposed on the reflector element 2.

The novel design of the upper reflector element makes it possible for fiber-reinforced plastic, e.g. carbon-fiber-reinforced, to be used in both the upper and the lower elements. Because this material has a very low coefficient of thermal expansion, it gives rise to low/small thermal deformations.

The upper reflector element in the embodiment shown in the figure contains only a small proportion of dielectric material in the form of the Kevlar spacers that hold the plates in position.

This results in low dielectric losses. As a result of its design and the choice of materials, the antenna system is thus well suited to the severe conditions that prevail in space, which include extreme temperature variations.

The invention is not limited to the embodiments described with reference to the figures, but can be varied freely within the scope of the claims that follow.

What is claimed is:

1. A reflector with first and second reflector elements disposed relative to one another in such a way that radiation that passes the first reflector element strikes the second reflector element, wherein the first reflector element comprises a lattice structure of electrically conductive plates disposed at a uniform distance from one another, and wherein the distance between the plates is adapted for the reflection of polarization parallel to the plates, and an extent of said plates varies over the reflector element such that a first plate and a second plate disposed at different areas of the reflector element may have depths different from other plates in the reflector, and wherein the extent of each respective plate toward the second reflector element is chosen so that the transmission losses in the first reflector element are minimized.

2. The reflector according to claim 1, wherein each respective plate in the lattice structure exhibits a gradually changed angle to the normal plane.

3. The reflector according to claim 1, wherein the first and second reflector elements are arranged at a fixed distance from one another by means of a surrounding frame.

4. The reflector according to claim 1, wherein each respective reflector element consists substantially of fiber-reinforced plastic.

5. The reflector according to claim 4, wherein the plates have a surface coating of a thin metallic layer.

6. The reflector according to claim 1, wherein the plates in the first reflector element are fixed in place by means of longitudinal spacers.

7. The reflector according to claim 1, wherein the reflector is configured to operate in a satellite antenna system.

* * * * *

UNITED STATES PATENT AND TRADEMARK OFFICE

CERTIFICATE OF CORRECTION

PATENT NO. : 6,940,464 B2 
DATED : September 6, 2005
INVENTOR(S) : Mikael Petersson and Per Ingvarson It is certified that error appears in the above-identified patent and that said Letters Patent is hereby corrected as shown below:

Title page,
Item [73], Assignee, change "Gothenburg" to -- Göteborg --.

Signed and Sealed this

First Day of November, 2005

JON W. DUDAS
*Director of the United States Patent and Trademark Office*